US008485280B2

(12) United States Patent
Drenth et al.

(10) Patent No.: US 8,485,280 B2
(45) Date of Patent: Jul. 16, 2013

(54) CORE DRILLING TOOLS WITH RETRACTABLY LOCKABLE DRIVEN LATCH MECHANISMS

(75) Inventors: Christopher L. Drenth, Draper, UT (US); George Iondov, Milton (CA); George Ibrahim, Mississauga (CA)

(73) Assignee: Longyear TM, Inc., South Jordan, UT (US)

( * ) Notice: Subject to any disclaimer, the term of this patent is extended or adjusted under 35 U.S.C. 154(b) by 129 days.

(21) Appl. No.: 12/968,127

(22) Filed: Dec. 14, 2010

(65) Prior Publication Data

US 2011/0079436 A1 Apr. 7, 2011

Related U.S. Application Data

(63) Continuation-in-part of application No. 12/898,878, filed on Oct. 6, 2010.

(60) Provisional application No. 61/287,106, filed on Dec. 16, 2009, provisional application No. 61/249,544, filed on Oct. 7, 2009, provisional application No. 61/287,106, filed on Dec. 16, 2009.

(51) Int. Cl.
*E21B 25/02* (2006.01)
*E21B 10/02* (2006.01)
*E21B 23/02* (2006.01)

(52) U.S. Cl.
USPC ..... 175/58; 175/246; 175/255; 175/403

(58) Field of Classification Search
USPC ..... 175/271, 272, 263, 284, 290, 403, 175/58, 244, 246, 248, 249, 255
See application file for complete search history.

(56) References Cited

U.S. PATENT DOCUMENTS 2,510,865 A 6/1950 Cooper
2,829,868 A 4/1958 Pickard (Continued)

FOREIGN PATENT DOCUMENTS

AU 2008222974 9/2008
AU 2010/0303446 4/2011

(Continued)

OTHER PUBLICATIONS

International Search Report and Written Opinion dated Oct. 28, 2009 as issued in International Application No. PCT/US2009/041435 filed Apr. 22, 2009.

(Continued)

*Primary Examiner* — Kenneth L Thompson
(74) *Attorney, Agent, or Firm* — Ballard Spahr LLP

(57) ABSTRACT

Implementations of the present invention include a core barrel assembly having a driven latch mechanism. The driven latch mechanism can lock the core barrel assembly axially and rotationally relative to a drill string. The driven latch mechanism can include a plurality of wedge members positioned on a plurality of driving surfaces. Rotation of the drill string can cause the plurality of wedge members to wedge between an inner diameter of the drill string and the plurality of driving surfaces, thereby rotationally locking the core barrel assembly relative to the drill string. The driven latch mechanism can further include a refracted groove adapted to lock the plurality of wedge members radially within the core barrel assembly, thereby allowing for faster travel within the drill string. Implementations of the present invention also include drilling systems including such driven latch mechanisms, and methods of retrieving a core sample using such drilling systems.

24 Claims, 8 Drawing Sheets

U.S. PATENT DOCUMENTS

| | | | | | |
|---|---|---|---|---|---|
| 3,092,191 | A | | 6/1963 | Mori et al. | |
| 3,103,981 | A | | 9/1963 | Harper | |
| 3,115,188 | A | | 12/1963 | Cochran et al. | |
| 3,126,064 | A | | 3/1964 | Miller | |
| 3,225,845 | A | | 12/1965 | Koontz et al. | |
| 3,346,059 | A | | 10/1967 | Svendsen | |
| 3,363,705 | A | | 1/1968 | Jensen | |
| 3,461,981 | A | | 8/1969 | Casper et al. | |
| 3,494,418 | A | | 2/1970 | Young | |
| 3,543,870 | A | | 12/1970 | Martinsen | |
| 3,667,558 | A | | 6/1972 | Lambot | |
| 3,977,482 | A | | 8/1976 | Reed et al. | |
| 4,418,770 | A | | 12/1983 | Lambot | |
| 4,466,497 | A | * | 8/1984 | Soinski et al. | 175/246 |
| 4,664,204 | A | | 5/1987 | Nenkov et al. | |
| 4,800,969 | A | | 1/1989 | Thompson | |
| 4,823,872 | A | | 4/1989 | Hopmann | |
| 4,832,138 | A | | 5/1989 | Hallez | |
| 4,834,198 | A | | 5/1989 | Thompson | |
| 4,930,587 | A | | 6/1990 | Young et al. | |
| 5,020,612 | A | | 6/1991 | Williams | |
| 5,267,620 | A | | 12/1993 | Lee | |
| 5,311,950 | A | | 5/1994 | Spektor | |
| 5,325,930 | A | | 7/1994 | Harrison | |
| 5,662,182 | A | | 9/1997 | McLeod et al. | |
| 5,785,134 | A | | 7/1998 | McLeod et al. | |
| 5,799,742 | A | | 9/1998 | Soinski | |
| 5,934,393 | A | | 8/1999 | Marshall | |
| 5,992,543 | A | | 11/1999 | Soinski et al. | |
| D420,013 | S | | 2/2000 | Warren et al. | |
| 6,019,181 | A | | 2/2000 | Soinski et al. | |
| 6,029,758 | A | | 2/2000 | Novacovicci et al. | |
| 6,039,129 | A | | 3/2000 | McLeod | |
| 6,059,053 | A | | 5/2000 | McLeod | |
| 6,089,335 | A | * | 7/2000 | Able | 175/246 |
| 6,371,205 | B1 | | 4/2002 | Langan et al. | |
| 6,425,449 | B1 | | 7/2002 | Marshall | |
| 6,564,885 | B2 | | 5/2003 | Attwater | |
| 6,708,784 | B1 | | 3/2004 | Borg | |
| 7,296,638 | B2 | | 11/2007 | Beach | |
| 7,314,101 | B2 | | 1/2008 | Beach | |
| 7,730,965 | B2 | | 6/2010 | Jordan et al. | |
| D622,293 | S | | 8/2010 | Drenth et al. | |
| D622,294 | S | | 8/2010 | Drenth et al. | |
| D622,741 | S | | 8/2010 | Drenth et al. | |
| D624,564 | S | | 9/2010 | Drenth et al. | |
| 7,841,400 | B2 | | 11/2010 | Wells et al. | |
| D632,309 | S | | 2/2011 | Coyle, Jr. | |
| 7,900,716 | B2 | | 3/2011 | Ibrahim et al. | |
| 7,967,085 | B2 | | 6/2011 | Drenth | |
| 8,333,255 | B2 | | 12/2012 | Drenth | 175/58 |
| 2004/0216927 | A1 | | 11/2004 | Beach | |
| 2005/0034894 | A1 | | 2/2005 | Beach et al. | |
| 2005/0241825 | A1 | | 11/2005 | Burris, II et al. | |
| 2009/0032256 | A1 | | 2/2009 | Sun et al. | |
| 2009/0173542 | A1 | | 7/2009 | Ibrahim et al. | |
| 2009/0260882 | A1 | | 10/2009 | Drenth | |
| 2009/0283328 | A1 | | 11/2009 | Drivdahl et al. | |
| 2011/0079435 | A1 | | 4/2011 | Drenth et al. | 175/58 |
| 2011/0079436 | A1 | | 4/2011 | Drenth et al. | 175/58 |

FOREIGN PATENT DOCUMENTS

| | | | |
|---|---|---|---|
| AU | 2010339878 | | 7/2011 |
| BR | 11 2012 008034 2 | | 4/2011 |
| BR | 1120120147870 | | 7/2011 |
| CA | 2679933 | | 9/2008 |
| CA | 2776923 | | 4/2011 |
| CA | 2784532 | | 7/2011 |
| CL | 88412 | | 4/2011 |
| CL | 2012-01618 | | 7/2011 |
| CN | 200880007004.5 | | 9/2008 |
| CN | 2010 80055434.1 | | 4/2011 |
| CN | 102782248 | A | 7/2011 |
| EP | 1757770 | A1 | 2/2007 |
| EP | 2132395 | A1 | 12/2009 |
| EP | 2486223 | | 8/2012 |
| EP | 2513413 | A2 | 10/2012 |
| GB | 992246 | | 5/1965 |
| NZ | 599635 | | 4/2011 |
| NZ | 600697 | | 7/2011 |
| PE | 446.2012 | | 4/2011 |
| PE | 823.2012 | | 7/2011 |
| WO | 9503475 | | 2/1995 |
| WO | 03038232 | A1 | 5/2003 |
| WO | WO 2008/109522 | | 9/2008 |
| WO | 2009108113 | A1 | 9/2009 |
| WO | 2010096860 | A1 | 9/2010 |
| WO | WO 2011/044314 | | 4/2011 |
| WO | WO 2011/084589 | | 7/2011 |
| ZA | 2009/05921 | | 9/2008 |
| ZA | 2012/03285 | | 4/2011 |
| ZA | 2012/05268 | | 7/2011 |

OTHER PUBLICATIONS

Office Action dated Jan. 6, 2011 from U.S. Appl. No. 12/427,586, filed Apr. 21, 2009 (17 Pages).

Notice of Allowance dated Feb. 25, 2011 from U.S. Appl. No. 12/427,586, filed Apr. 21, 2009 (6 Pages).

Notice of Allowance dated Apr. 6, 2011 from U.S. Appl. No. 29/383,340, filed Jan. 14, 2011 (10 pages).

Notice of Allowance dated Apr. 6, 2011 from U.S. Appl. No. 29/383,561, filed Jan. 19, 2011 (10 pages).

Notice of Allowance dated Apr. 8, 2011 from U.S. Appl. No. 29/383,572, filed Jan. 19, 2011 (10 pages).

Notice of Allowance dated May 26, 2011 from U.S. Appl. No. 29/383,623, filed Jan. 20, 2011 (10 pages).

Issue Notification dated Jun. 8, 2011 from U.S. Appl. No. 12/427,586, filed Apr. 21, 2009 (1 page).

Notice of Allowance dated Aug. 1, 2011 from U.S. Appl. No. 29/383,554, filed Jan. 19, 2011 (10 pages).

Supplemental Notice of Allowance dated Jul. 11, 2011 from U.S. Appl. No. 29/383,340, filed Jan. 14, 2011 (6 pages).

Supplemental Notice of Allowance dated Jul. 11, 2011 from U.S. Appl. No. 29/383,561, filed Jan. 19, 2011 (6 pages).

Issue Notification dated Aug. 3, 2011 from U.S. Appl. No. 29/383,561, filed Jan. 19, 2011 (1 page).

Issue Notification dated Jul. 27, 2011 from U.S. Appl. No. 29/383,572, filed Jan. 19, 2011 (1 page).

Office Action dated Aug. 1, 2011 from U.S. Appl. No. 12/528,949, filed Aug. 27, 2009 (8 pages.).

Notice of Allowance dated Aug. 4, 2011 from U.S. Appl. No. 29/383,623, filed Jan. 20, 2011 (10 pages).

First Action Interview Pilot Program Pre-Interview Communication dated Jul. 8, 2011 from U.S. Appl. No. 13/094,581, filed Apr. 26, 2011 (4 pages).

First Action Interview Pilot Program Pre-Interview Communication dated Jul. 1, 2011 from U.S. Appl. No. 13/094,674, filed Apr. 26, 2011 (4 pages).

Notice of Allowance dated Aug. 25, 2011 from U.S. Appl. No. 13/094,581, filed Apr. 26, 2011 (9 pages).

Issue Notification dated Oct. 19, 2011 from U.S. Appl. No. 13/094,581, filed Apr. 26, 2011 (1 page).

Notice of Allowance dated Aug. 19, 2011 from U.S. Appl. No. 13/094,674, filed Apr. 26, 2011 (11 pages).

Issue Notification dated Oct. 19, 2011 from U.S. Appl. No. 13/094,674, filed Apr. 26, 2011 (1 page).

Notice of Allowance dated Sep. 20, 2011 from U.S. Appl. No. 29/383,554, filed Jan. 19, 2011 (10 pages).

Issue Notification dated Aug. 17, 2011 from U.S. Appl. No. 29/383,340, filed Jan. 14, 2011 (1 page).

International Search Report and Written Opinion dated Jul. 27, 2011 from International Patent Application No. PCT/US2010/060744 filed Dec. 16, 2010 (6 pages).

International Search Report and Written Opinion dated Jul. 27, 2011 from International Patent Application No. PCT/US2010/060742 filed Dec. 16, 2010 (6 pages).

Issue Notification dated Oct. 5, 2011 from U.S. Appl. No. 29/383,623, filed Jan. 20, 2011 (1 page).

Notice of Allowance dated Nov. 2, 2011 from U.S. Appl. No. 29/383,554, filed Jan. 19, 2011 (1 page).

Amendment in Response to Communication Pursuant to Rules 161(2) and 162 filed Dec. 4, 2012 for European Patent Application No. EP10822658.0, which was filed Oct. 7, 2010 (Inventor—Drenth; Applicant—Longyear TM, Inc.; (pp. 1-7).
Examination Report issued Aug. 11, 2010 for Australian Patent Application No. 2008222974, which was filed on Mar. 3, 2008 (Inventor—Drenth; Applicant—Boart Longyear; (pp. 1-1).
First Office Action issued Nov. 24, 2011 for Chinese Patent Application No. 2008800070045, which was filed on Mar. 3, 2008 (Inventor—Drenth; Applicant—Boart Longyear; (pp. 1-8).
International Preliminary Report on Patentability issued Apr. 11, 2012 for International Patent Application No. PCT/US2010/051747, which was filed Oct. 7, 2010 (Inventor—Drenth; Applicant—Longyear TM, Inc.; (pp. 1-6).
International Preliminary Report on Patentability issued Aug. 8, 2008 for International Patent Application No. PCT/US2008/055656, which was filed Mar. 3, 2008 (Inventor—Drenth; Applicant—Boat Longyear; (pp. 1-6).
International Preliminary Report on Patentability issued Jun. 19, 2012 for International Patent Application No. PCT/US2010/060744, which was filed Dec. 16, 2010 (Inventor—Drenth; Applicant—Longyear TM, Inc.; (pp. 1-4).
International Search Report and Written Opinion issued Aug. 8. 2008 for International Patent Application No. PCT/US2008/055656, filed Mar. 3, 2008 (Inventor—Drenth; Applicant—Boart Longyear; (pp. 1-5).
International Search Report and Written Opinion issued Jun. 10, 2011 for International Patent Application No. PCT/US2010/051747, filed Oct. 7, 2010 (Inventor—Drenth; Applicant—Longyear TM, Inc.; (pp. 1-7).
Issue Notification issued Nov. 2. for U.S. Appl. No. 29/383,554, filed Jan. 19, 2011 (Inventor—Drenth; Applicant—Boart Longyear; (pp. 1-1).
Notice of Acceptance issued Feb. 3, 2011 for Australian Patent Application No. 2008222974, which was filed on Mar. 3, 2008 (Inventor—Drenth; Applicant—Boart Longyear; (pp. 1-1).
Preliminary Amendment filed Sep. 27, 2011 for U.S. Appl. No. 12/898,878, filed Oct. 6, 2010 (Inventor—Drenth; Applicant—Longyear TM, Inc.; (pp. 1-10).
Response to Examination Report filed Jan. 21, 2011 for Australian Patent Application No. 2008222974, which was filed Sep. 12, 2008 (Inventor—Drenth; Applicant—Boart Longyear; (pp. 1-17).
Response to First Office Action filed Jun. 11, 2012 for Chinese Patent Application No. 2008800070045, which was filed on Mar. 3, 2008 (Inventor—Drenth; Applicant—Boort Longyear; (pp. 1-16).
Voluntary Amendment filed Oct. 15, 2009 for Australian Patent Application No. 2008222974, which was filed on Mar. 3, 2008 (Inventor—Drenth; Applicant—Boart Longyear; (pp. 1-5).

* cited by examiner

CORE DRILLING TOOLS WITH RETRACTABLY LOCKABLE DRIVEN LATCH MECHANISMS

CROSS-REFERENCE TO RELATED APPLICATIONS

This application claims priority to and the benefit of U.S. Provisional Application No. 61/287,106, filed Dec. 16, 2009, entitled "Driven Latch Mechanism for High Productivity Core Drilling." This application is also a continuation-in-part application of U.S. patent application Ser. No. 12/898,878, filed on Oct. 6, 2010, and entitled "Driven Latch Mechanism," which claims priority to and the benefit of U.S. Provisional Application No. 61/249,544, filed Oct. 7, 2009, entitled "Driven Latch Mechanism" and U.S. Provisional Application No. 61/287,106, filed Dec. 16, 2009, entitled "Driven Latch Mechanism for High Productivity Core Drilling." The contents of the above-referenced patent applications are hereby incorporated by reference in their entirety.

BACKGROUND OF THE INVENTION

1. The Field of the Invention

Implementations of the present invention relate generally to drilling devices and methods that may be used to drill geological and/or manmade formations. In particular, implementations of the present invention relate to core barrel assemblies.

2. The Relevant Technology

Core drilling (or core sampling) includes obtaining core samples of subterranean formations at various depths for various reasons. For example, a retrieved core sample can indicate what materials, such as petroleum, precious metals, and other desirable materials, are present or are likely to be present in a particular formation, and at what depths. In some cases, core sampling can be used to give a geological timeline of materials and events. As such, core sampling may be used to determine the desirability of further exploration in a particular area.

Wireline drilling systems are one common type of drilling system for retrieving a core sample. In a wireline drilling process, a core drill bit is attached to the leading edge of an outer tube or drill rod. A drill string is then formed by attaching a series of drill rods that are assembled together section by section as the outer tube is lowered deeper into the desired formation. A core barrel assembly is then lowered or pumped into the drill string. The core drill bit is rotated, pushed, and/or vibrated into the formation, thereby causing a sample of the desired material to enter into the core barrel assembly. Once the core sample is obtained, the core barrel assembly is retrieved from the drill string using a wireline. The core sample can then be removed from the core barrel assembly.

Core barrel assemblies commonly include a core barrel for receiving the core, and a head assembly for attaching the core barrel assembly to the wireline. Typically, the core barrel assembly is lowered into the drill string until the core barrel reaches a landing seat on an outer tube or distal most drill rod. At this point a latch on the head assembly is deployed to restrict the movement of the core barrel assembly with respect to the drill rod. Once latched, the core barrel assembly is then advanced into the formation along with the drill rod, causing material to fill the core barrel.

One potential challenge can arise due to the interaction between the core barrel assembly and the drill string. For example, when the drill string is spinning, the inertia of the core barrel assembly can exceed the frictional resistance between the mating components such that the head assembly rotates at a lower rate than the drill rod or fails to rotate and remains stationary. In such a situation, the mating components can suffer sliding contact, which can result in abrasive wear.

Often it may be desirable to obtain core samples at various depths in a formation. Furthermore, in some cases, it may be desirable to retrieve core samples at depths of thousands of feet below ground-level, or otherwise along a drilling path. In such cases, retrieving a core sample may require the time consuming and costly process of removing the entire drill string (or tripping the drill string out) from the borehole. In other cases, a wireline drilling system may be used to avoid the hassle and time associated with tripping the entire drill string. Even when using a wireline drilling system, tripping the core barrel assembly in and out of the drill string is nonetheless time-consuming.

Accordingly, there are a number of disadvantages in conventional wireline systems that can be addressed.

BRIEF SUMMARY OF THE INVENTION

One or more implementations of the present invention overcome one or more problems in the art with drilling tools, systems, and methods for effectively and efficiently obtaining core samples. For example, one or more implementations of the present invention include a core barrel assembly having a driven latch mechanism that can reliably lock the core barrel assembly axially and rotationally to a drill string. Additionally, the driven latch mechanism can be radially retracted and locked within a retracted position during tripping of the core barrel assembly in and out of the drill string. The refracted position of the driven latch mechanism during tripping of the core barrel assembly can allow for greater fluid flow between the drill string and the core barrel assembly; and thus, faster tripping of the core barrel assembly.

For example, one implementation of a core barrel head assembly includes a sleeve having a plurality of openings extending there through. The core barrel head assembly can also include a plurality of wedge members positioned at least partially within the plurality of openings. The plurality of wedge members can be adapted to axially and rotationally lock the sleeve relative to a drill string. Additionally, the core barrel head assembly can include a driving member positioned at least partially within the sleeve. The driving member can include at least one groove extending therein. The at least one groove can be configured to receive and maintain said plurality of wedge members in a retracted position within the sleeve.

Additionally, another implementation of a core barrel head assembly can include a sleeve and a driving member moveably coupled to the sleeve. The core barrel head assembly can also include a plurality of wedge members positioned on the driving member. Axial movement of the driving member relative to the sleeve can move the plurality of wedge members radially relative to the sleeve between a latched position and a retracted position. Further, the core barrel head assembly can include at least one groove extending into the driving member. The at least one groove can receive and lock the plurality of wedge members in the retracted position.

Furthermore, an implementation of a drilling system for retrieving a core sample can include a drill string comprising a plurality of drill rods. The drilling system can also include a core barrel assembly adapted to be inserted within the drill string. Additionally, the drilling system can include a driven latch mechanism positioned within the core barrel assembly. The driven latch mechanism can rotationally and axially lock the core barrel assembly relative to the drill string. The driven latch mechanism can include a plurality of wedge members positioned on a driving member. The driving member can include at least one groove adapted to receive and lock the plurality of wedge members relative to the driving member.

In addition to the foregoing, a method of drilling using a core barrel assembly comprising a sleeve, a driving member, and a plurality of wedge members can involve manipulating the core barrel assembly to position the plurality of wedge members into at least one refracted groove on the driving member. The at least one retracted groove can hold the plurality of wedge members radially within said sleeve. The method can also involve inserting the core barrel assembly within a drill string. Additionally, the method can involve sending the core barrel assembly along the drill string to a drilling position. Upon reaching the drilling position, the plurality of wedge members can move out of the at least one refracted groove into a deployed position in which the plurality of wedge members extend at least partially radially outward of the sleeve. Still further the method can involve rotating the drill string thereby causing the plurality of wedge members to wedge between an inner surface of the drill string and the driving member. The wedging of the plurality of wedge members between an inner surface of the drill string and the driving member can rotationally locking the core barrel assembly relative to the drill string.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
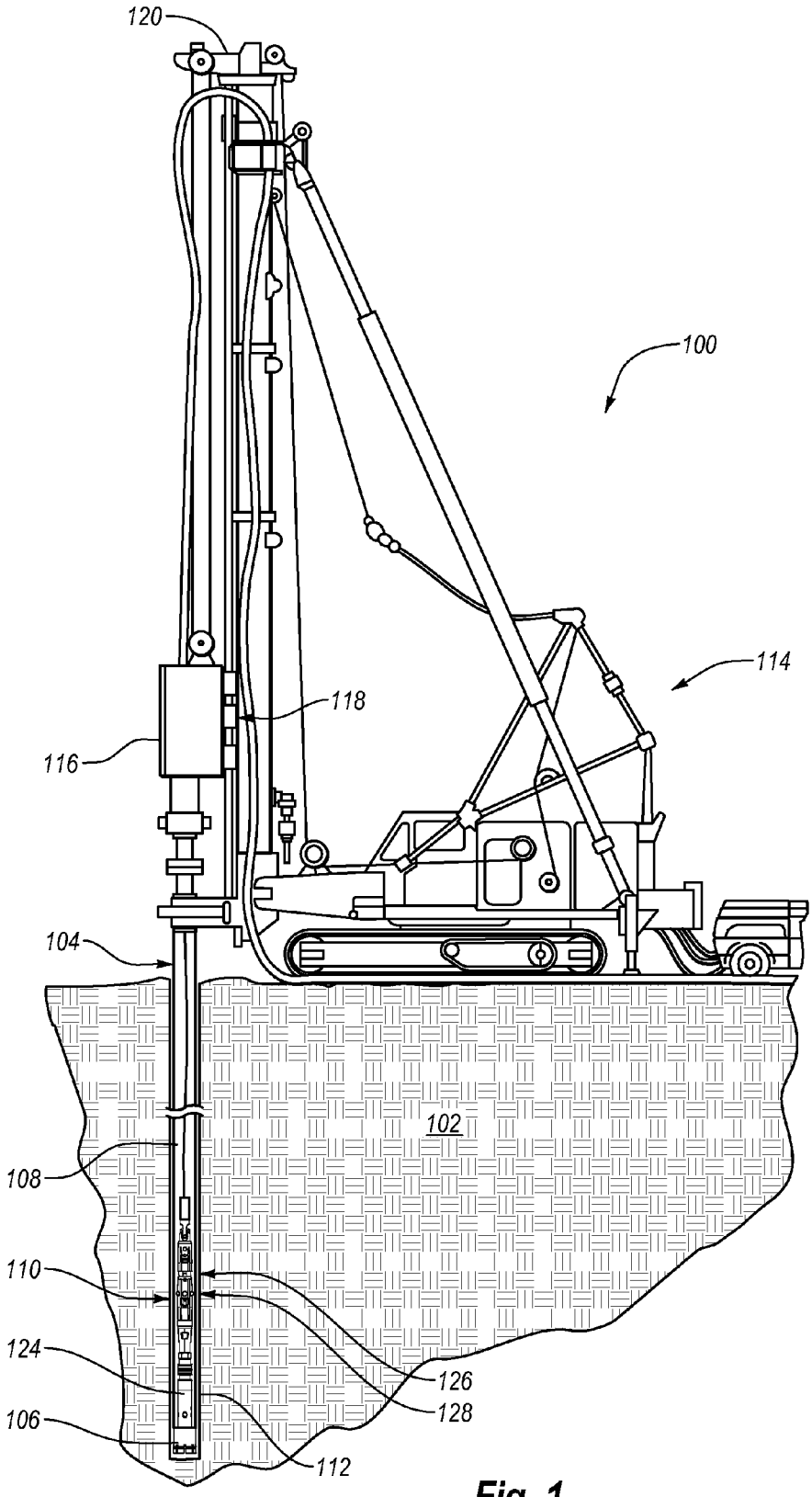
FIG. 1 illustrates a schematic view a drilling system including a core barrel assembly having a driven latch mechanism in accordance with an implementation of the present invention.

Implementations of the present invention are directed toward drilling tools, systems, and methods for effectively and efficiently obtaining core samples. For example, one or more implementations of the present invention include a core barrel assembly having a driven latch mechanism that can reliably lock the core barrel assembly axially and rotationally to a drill string. Additionally, the driven latch mechanism can be radially refracted and locked within a retracted position during tripping of the core barrel assembly in and out of the drill string. The retracted position of the driven latch mechanism during tripping of the core barrel assembly can allow for greater fluid flow between the drill string and the core barrel assembly; and thus, faster tripping of the core barrel assembly.

In particular, by locking the driven latch mechanism in a radially retracted position, the driven latch mechanism can be prevented from dragging along the inner surfaces of the drill string as the core barrel assembly is during tripped in and out of the drill string. Furthermore, by locking the driven latch mechanism in a radially retracted position, the space between the outer surfaces of the core barrel assembly and the drill string can be increased; thereby allowing for easier passage of drilling fluid or ground water that may be present during tripping of the core barrel assembly. Accordingly, one or more implementations of the present invention can increase productivity and efficiency in core drilling operations by reducing the time required for the core barrel assembly to travel through the drill string.

Assemblies, systems, and methods of one or more implementations can include or make use of a driven latch mechanism for securing a core barrel assembly at a desired position within a tubular member, such as a drill rod of a drill string. The driven latch mechanism can include a plurality of wedge members, and a driving member having a plurality of driving surfaces. The driving surfaces can drive the wedge members to interact with an inner surface of a drill rod to latch or lock the core barrel assembly in a desired position within the drill string. Thereafter, rotation of the drill rod can cause the wedge members to wedge between the drive surfaces and the inner diameter of the drill rod, thereby rotationally locking the core barrel relative to the drill string.

Furthermore, one or more implementations provide a driven latch mechanism that can maintain a deployed or latched condition despite vibration and inertial loading of mating head assembly components due to drilling operations or abnormal drill string movement. Also, one or more implementations can provide a latch mechanism that does not disengage or retract unintentionally, and thus prevents the core barrel inner tube assembly from rising from the drilling position in a down-angled hole.

In one or more implementations, a biasing member can be used to move the wedge members to the appropriate axial positions on the driving surfaces. The driving surfaces can have one or more features, such as grooves, to maintain or lock the wedge members at one or more desired axial positions. These desired axial positions can correspond to a deployed state and/or a retracted state, as alluded to earlier. When in the deployed state, the wedge members can be positioned to engage the drill string. On the other hand, when in the retracted state, the wedge members can be retracted from engagement with the drill string. Such a configuration can help reduce friction between the wedge members and the drill string; and thereby, increase the speed with which the assembly can be tripped in and out of the drill string.

For ease of reference, the driven latch mechanism shall be described with generally planar driving surfaces and spherical or ball-shaped wedge members. It will be appreciated that the driving members can have any number of driving surfaces with any desired shape, including, but not limited to, convex, concave, patterned or any other shape or configuration capable of wedging a wedge member as desired. Further, the wedge members can have any shape and configuration possible. In at least one example, a universal-type joint can replace the generally spherical wedge members, tapered planar drive surfaces, and accompanying sockets. Thus, the present invention can be embodied in other specific forms without departing from its spirit or essential characteristics. The described implementations are to be considered in all respects only as illustrative and not restrictive.

In other words, the following description supplies specific details in order to provide a thorough understanding of the invention. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques. For example, while the description below focuses on core sampling operations, the apparatus and associated methods could be equally applied in other drilling processes, such as in conventional borehole drilling, and may be used with any number or varieties of drilling systems, such as rotary drill systems, percussive drill systems, etc.

Further, while the Figures show five wedge members in the latching mechanism, any number of latches may be used. In at least one example, six ball-shaped wedge members will be used in a driven latch mechanism. Similarly, the precise configuration of components as illustrated may be modified or rearranged as desired by one of ordinary skill. Additionally, while the illustrated implementations specifically discuss a wireline system, any retrieval system may be used.

As shown in FIG. 1, a drilling system 100 may be used to retrieve a core sample from a formation 102. The drilling system 100 may include a drill string 104 that may include a drill bit 106 (for example, an open-faced drill bit or other type of drill bit) and/or one or more drill rods 108. The drilling system 100 may also include an in-hole assembly, such as a core barrel assembly 110. The core barrel assembly 110 can include a driven latch mechanism 128 configured to lock the core barrel assembly at least partially within a distal drill rod or outer tube 112, as explained in greater detail below. As used herein the terms "down" and "distal end" refer to the end of the drill string 104 including the drill bit 106. While the terms "up" or "proximal" refer to the end of the drill string 104 opposite the drill bit 106.

The drilling system 100 may include a drill rig 114 that may rotate and/or push the drill bit 106, the core barrel assembly 110, the drill rods 108 and/or other portions of the drill string 104 into the formation 102. The drill rig 114 may include, for example, a rotary drill head 116, a sled assembly 118, and a mast 120. The drill head 116 may be coupled to the drill string 104, and can allow the rotary drill head 116 to rotate the drill bit 106, the core barrel assembly 110, the drill rods 108 and/or other portions of the drill string 104. If desired, the rotary drill head 116 may be configured to vary the speed and/or direction that it rotates these components. The sled assembly 118 can move relative to the mast 120. As the sled assembly 118 moves relative to the mast 120, the sled assembly 118 may provide a force against the rotary drill head 116, which may push the drill bit 106, the core barrel assembly 110, the drill rods 108 and/or other portions of the drill string 104 further into the formation 102, for example, while they are being rotated.

It will be appreciated, however, that the drill rig 114 does not require a rotary drill head, a sled assembly, a slide frame or a drive assembly and that the drill rig 114 may include other suitable components. It will also be appreciated that the drilling system 100 does not require a drill rig and that the drilling system 100 may include other suitable components that may rotate and/or push the drill bit 106, the core barrel assembly 110, the drill rods 108 and/or other portions of the drill string 104 into the formation 102. For example, sonic, percussive, or down hole motors may be used.

The core barrel assembly 110 may include an inner tube or core barrel 124, and a head assembly 126. The head assembly 126 can include a driven latch mechanism 128. As explained in greater detail below, the driven latch mechanism 128 can lock the core barrel 124 within the drill string 104, and particularly to the outer tube 112. Furthermore, the driven latch mechanism 128 can rotationally lock the core barrel assembly 110 to the drill string 104 thereby preventing wear due to rotation or sliding between the mating components of the driven latch mechanism 128 and the drill string 104.

Once the core barrel 124 is locked to the outer tube 112 via the driven latch mechanism 128, the drill bit 106, the core barrel assembly 110, the drill rods 108 and/or other portions of the drill string 104 may be rotated and/or pushed into the formation 102 to allow a core sample to be collected within the core barrel 124. After the core sample is collected, the core barrel assembly 110 may be unlocked from the outer tube 112 and drill string 104. The core barrel assembly 110 may then be retrieved, for instance using a wireline retrieval system, while the drill bit 106, the outer tube 112, one or more of the drill rods 108 and/or other portions of the drill string 104 remain within the borehole.

The core sample may be removed from core barrel 124 of the retrieved core barrel assembly 110. After the core sample is removed, the core barrel assembly 110 may be sent back and locked to the outer tube 112. With the core barrel assembly 110 once again locked to the outer tube 112, the drill bit 106, the core barrel assembly 110, the drill rods 108 and/or other portions of the drill string 104 may be rotated and/or pushed further into the formation 102 to allow another core sample to be collected within the core barrel 124. The core barrel assembly 110 may be repeatedly retrieved and sent back in this manner to obtain several core samples, while the drill bit 106, the outer tube 112, one or more of the drill rods 108 and/or other portions of the drill string 104 remain within the borehole. This may advantageously reduce the time necessary to obtain core samples because the drill string 104 need not be tripped out of the borehole for each core sample.

Figure 2:
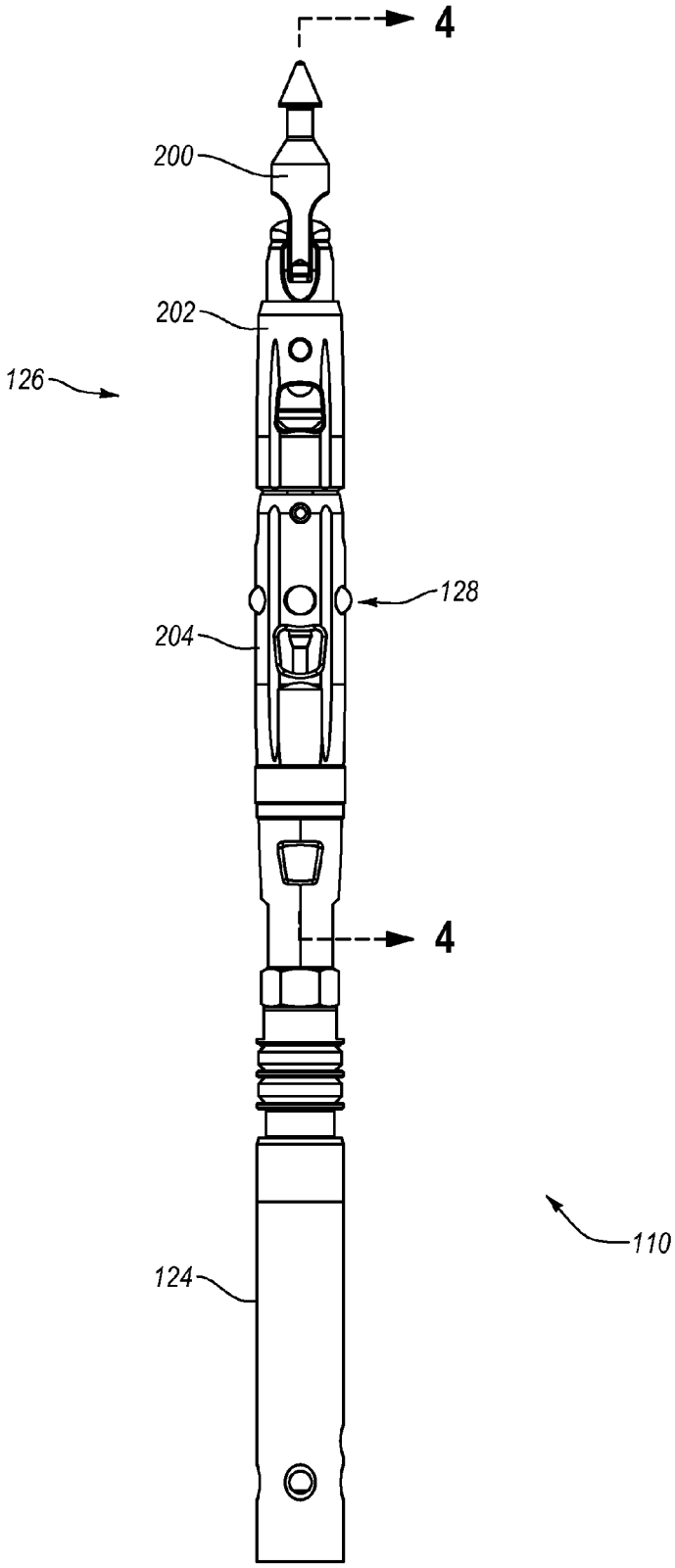
FIG. 2 illustrates an enlarged view of the core barrel assembly of FIG. 1, further illustrating a head assembly and a core barrel.

FIG. 2 illustrates the core barrel assembly 110 in greater detail. As previously mentioned, the core barrel assembly 110 can include a head assembly 126 and a core barrel 124. The head assembly 126 can include a spear head assembly 200 adapted to couple with an overshot, which in turn can be attached to a wireline. Furthermore, the head assembly 126 can include a first member 202, and a sleeve 204 that can house the driven latch mechanism 128.

Figure 3:
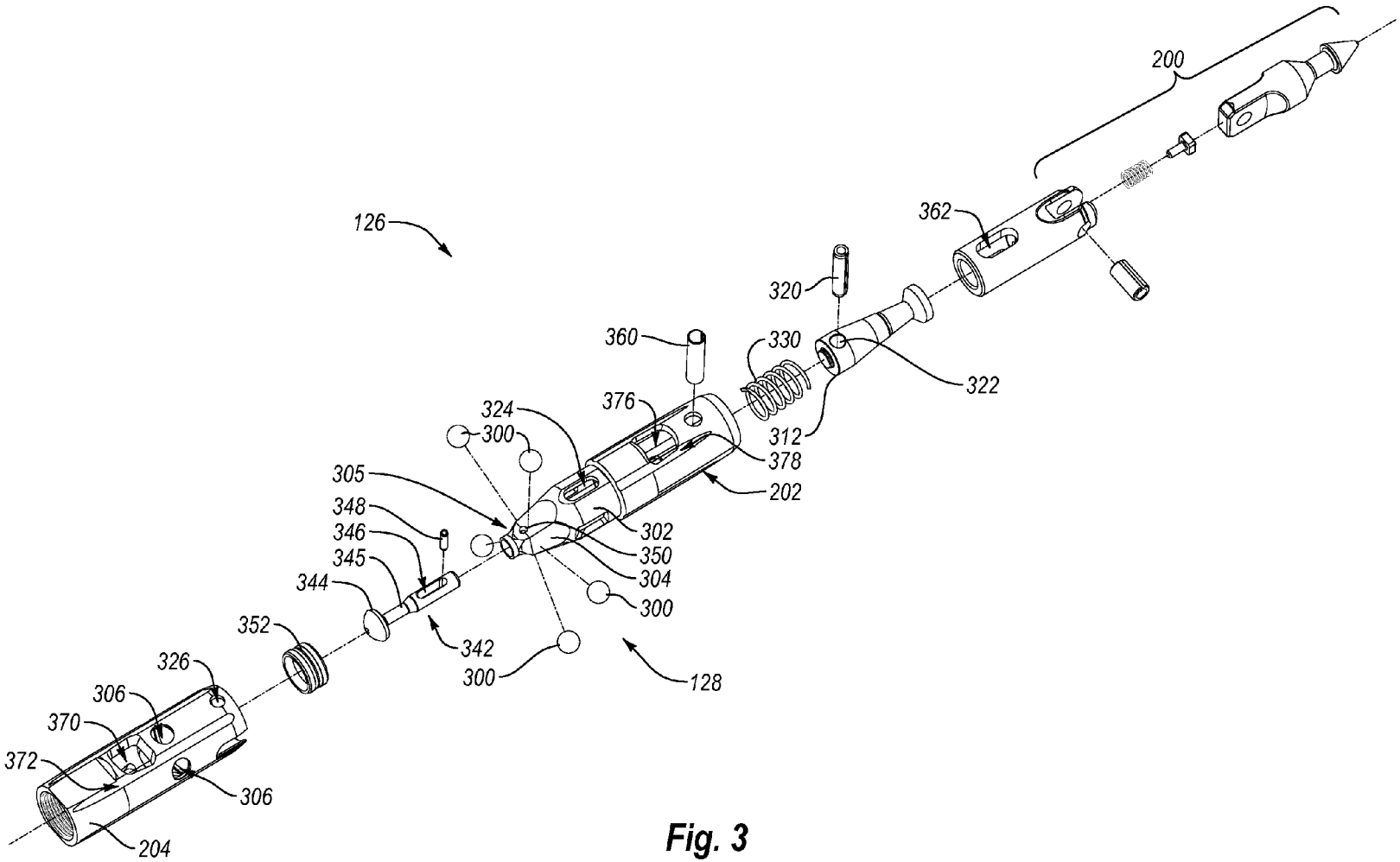
FIG. 3 illustrates an exploded view of the head assembly of FIG. 2.
Figure 4:
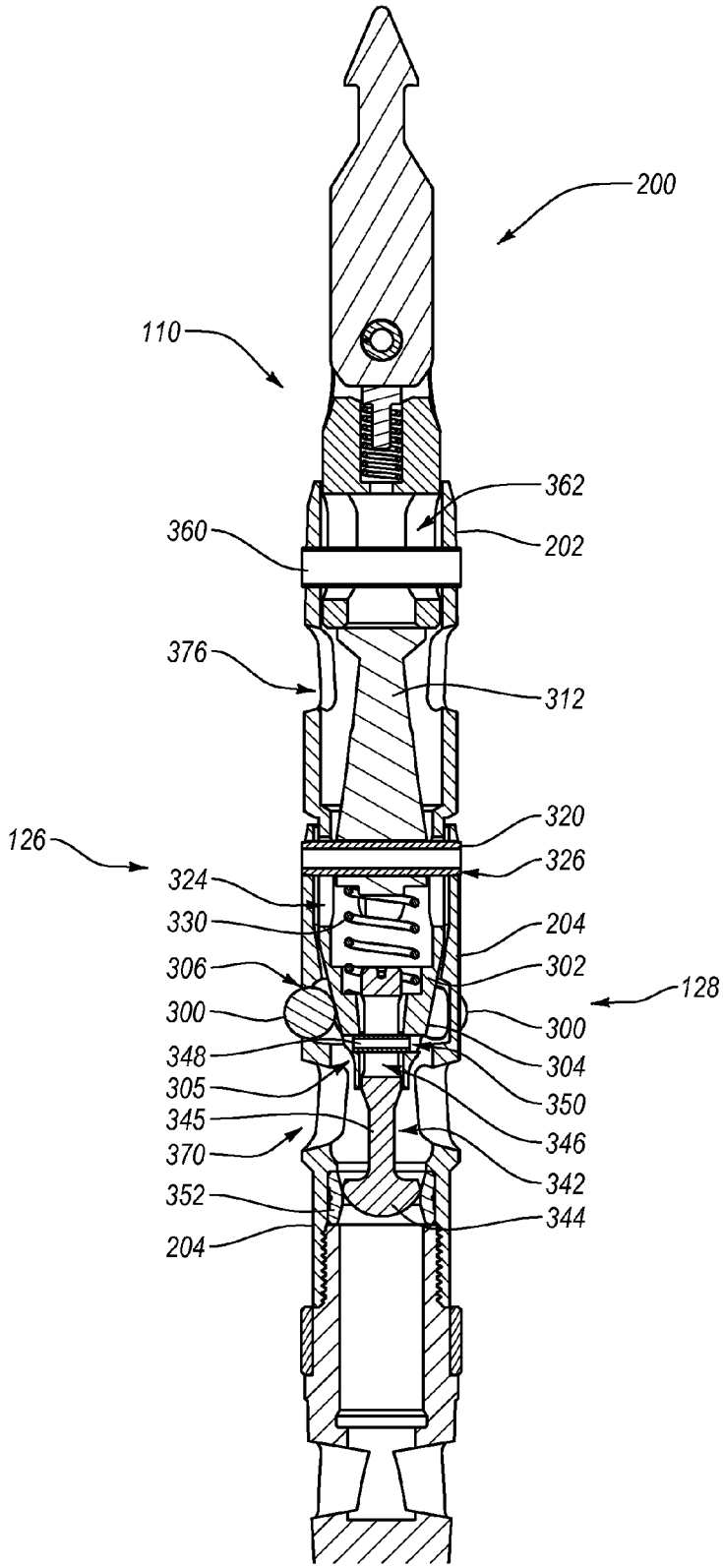
FIG. 4 illustrates a cross-sectional view of the core barrel assembly of FIG. 2 taken along the line 4-4 of FIG. 2.

FIGS. 3 and 4 and the corresponding text, illustrate or describe a number of components, details, and features of the core barrel assembly 110 shown in FIGS. 1 and 2. In particular, FIG. 3 illustrates an exploded view of the head assembly 126. While FIG. 4 illustrates a side, cross-sectional view of the core barrel assembly 110 taken along the line 4-4 of FIG. 2. FIG. 4 illustrates the driven latch mechanism 128 in a fully deployed state. As shown by FIGS. 3 and 4, the driven latch mechanism 128 can include a plurality of wedge members 300. In one or more implementations, the wedge members 300 can comprise a spherical shape or be roller balls, as shown in FIGS. 3 and 4. The wedge members 300 may be made of steel, or other iron alloys, titanium and titanium alloys, compounds using aramid fibers, lubrication impregnated nylons or plastics, combinations thereof, or other suitable materials.

The wedge members 300 can be positioned on or against a driving member 302. More particularly, the wedge members 300 can be positioned on generally planar or flat driving surfaces 304. As explained in greater detail below, the generally planar configuration of the driving surfaces 304 can allow the wedge members 300 to be wedged between the driving member 302 and the inner diameter of a drill string to rotationally lock the core barrel assembly 110 to the drill string.

Figure 5:
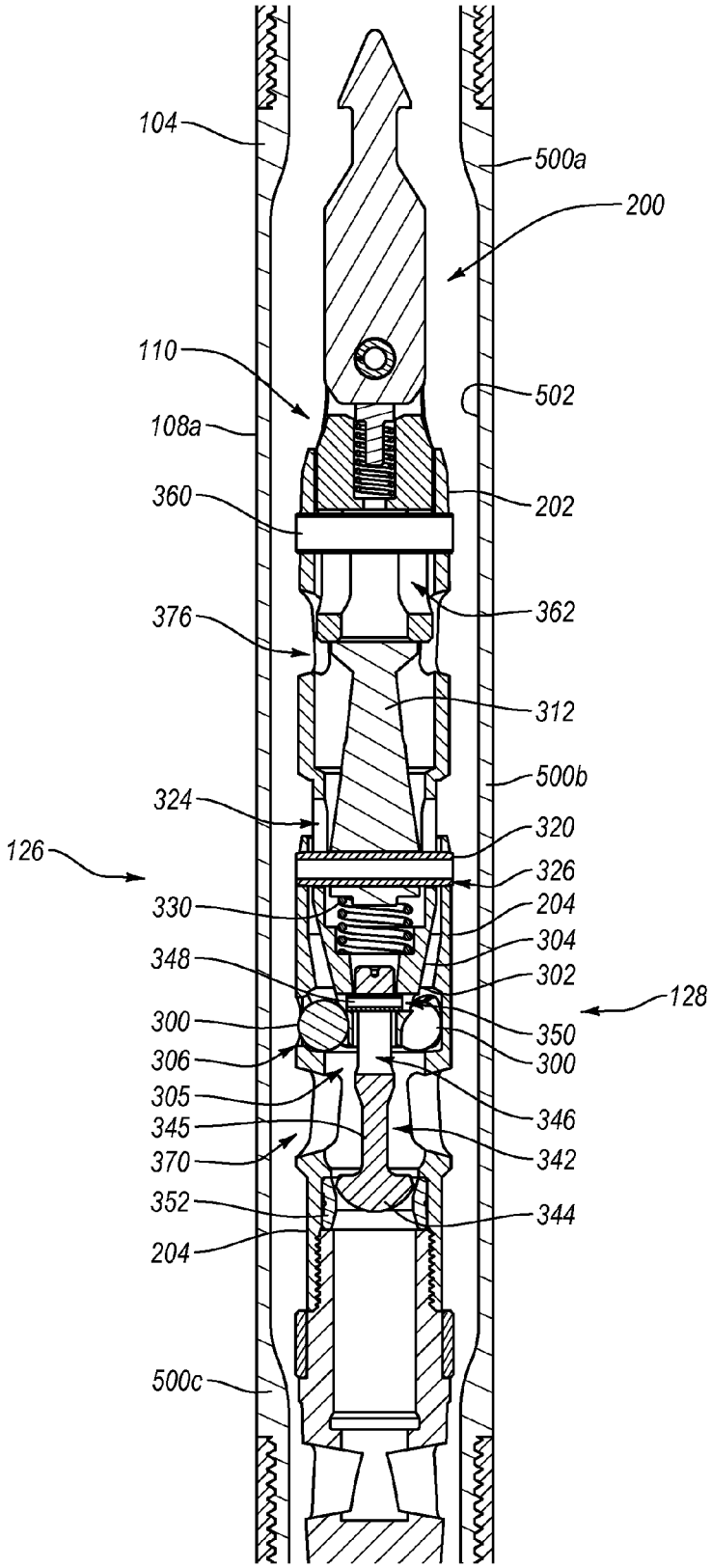
FIG. 5 illustrates a cross-sectional view of the core barrel assembly of FIG. 2 similar to FIG. 4, albeit with the driven latch mechanism locked in a retracted position for tripping the core barrel assembly into or from a drill string.
Figure 6:
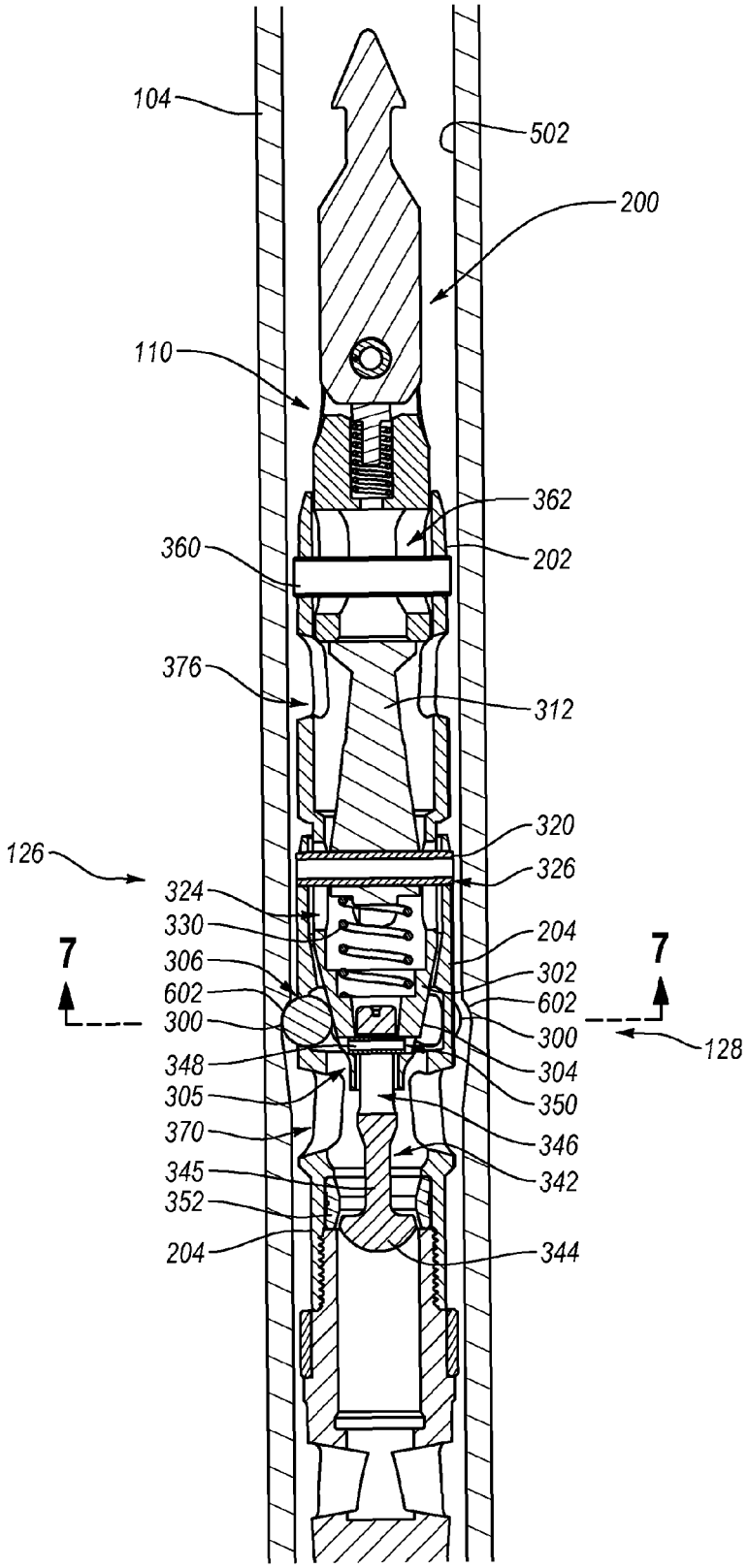
FIG. 6 illustrates a cross-sectional view of the core barrel assembly similar to FIG. 4, albeit with the driven latch mechanism latched to the drill string.

FIGS. 3 and 4 further illustrate that the wedge members 300 can extend through latch openings 306 extending through the generally hollow sleeve 204. The latch openings 306 can help hold or maintain the wedge members 300 in contact with the driving surfaces 304, which in turn can ensure that axial movement of the driving member 302 relative to the sleeve 204 results in radial displacement of the wedge members 300. As explained in greater detail below, as the driving member 302 moves axially toward or farther into the sleeve 204, the driving surfaces 304 can force the wedge members 300 radially outward of the sleeve 204 to a deployed or latched position (FIG. 6). Along similar lines, as the driving member 302 moves axially away from, or out of the sleeve 204, the wedge members 300 can radially retract at least partially into the sleeve 204 into a released position (FIG. 5).

As alluded to earlier, in at least one implementation, the driving member 302 can include one or more grooves for locking the wedge members 300 in position axially along the driving member 302. For example, the driving member 302 can include a retracted groove 305. As explained in greater detail below, the retracted groove 305 can receive and hold the wedge members 300 in a radially retracted position during tripping of the core barrel assembly 110 in or out of a drill string 104.

As used herein the term "groove" refers to any feature or geometry capable of receiving and/or maintaining one or more wedge members 300 in a desired positioned along the driving member 302 (and thus a desired radial position, for example, a retracted position or a deployed position). Thus, as shown in FIG. 4, the retracted groove 305 can comprise a lip structure that prevents one or more wedge members 300 from moving axially along the driving member 302 toward the first member 202. In alternative implementations, the refracted groove 305 can comprise a double lip structure that prevents one or more wedge members 300 from moving axially along the driving member 302 toward or away from the first member 202. In yet further implementations, the retracted groove 305 can comprise a circular shaped depression corresponding in size and shape to a wedge member 300. In still further implementations, the retracted groove 305 can comprise a protrusion instead of a recess. One will thus appreciate that the retracted groove 305 (and the deployment groove 802 described herein below) can comprise a feature having any geometry or shape that allows for maintaining one or more wedge members 300 in a desired positioned along the driving member 302.

In one or more implementations, the driving member 302, and more particularly the planar driving surfaces 304 can have a taper, as shown in FIGS. 3 and 4. The taper can allow the driving member 302 to force the wedge balls 300 radially outward as the driving member 302 moves axially closer to, or within, the sleeve 204. Also, the taper of the driving member 302 can allow the wedge members 300 to radially retract at least partially into the sleeve 204 when the driving member 302 moves axially away from the sleeve 204. One will appreciate that the driving member 302 (and driving surfaces 304) need not be tapered. For example, in alternative implementations, the driving member 302 can include a first portion have a smaller diameter, a transition portion, and a second portion with a larger diameter. In other words, the driving member 302 can include a step between a smaller diameter and a larger diameter instead of a taper along its length. The smaller diameter portion of the driving member 302 of such implementations can allow the wedge balls 300 to retract at least partially into the sleeve 204, and the larger diameter of the driving member 302 can force the wedge balls 300 radially outward in order to lock or latch to the drill string 104.

In at least one implementation, the refracted groove 305 can be positioned on the smaller end of the taper of the driving member 302. This can ensure that when the wedge members 300 are secured within the retracted groove 305, the wedge members 300 will be at least partially radially refracted within the sleeve 204. In at least one implementation, the wedge members 300 can be fully retracted within the sleeve 204, when received within the refracted groove 305. In any event, the retracted groove 305 can maintain the wedge members 300 sufficiently within the sleeve 204 as to not engage the drill string 104. Maintaining the wedge members 300 thus retracted within the sleeve 204 can reduce contact between the wedge members 300 and the drill string 104, which in turn can reduce friction and thereby allow for rapid tripping of the core barrel assembly 110 in and out of the drill string 104.

As shown by FIGS. 3 and 4, the retracted groove 305 can extend radially into the driving surfaces 304 of the driving member 302. In the implementation illustrated in the figures, the retracted groove 305 comprises a single groove extending circumferentially around the driving member 302. In alternative implementations, however, the retracted groove 305 can comprise a plurality of grooves positioned on the driving member 302. In such implementations, each of the plurality of retracted grooves can receive and lock a single wedge member 300 in a retracted position.

FIGS. 3 and 4 further illustrate that in addition to first member 202 can be generally hollow and can house a landing member 312. One will appreciate that the sleeve 204, first member 202, and landing member 312 can all be coupled together. In particular, as shown by FIGS. 3 and 4, in at least one implementation a first pin 320 can extend through a mounting channel 322 in the landing member 312. The first pin 320 can then extend through mounting slots 324 of the first member 202 (and more particularly the driving member 302). From the mounting slots 324, the first pin 320 can extend into mounting holes 326 in the sleeve 204. Thus, the landing member 312 and the sleeve 204 can be axially fixed relative to each other. On the other hand, the mounting slots 324 can allow the landing member 312 and the sleeve 204 to move axially relative to the first member 202 or vice versa. Axial movement between the first member 202 and the sleeve 204 can cause the driving surfaces 304 to move the wedge members 300 radially outward and inward.

In alternative implementations, the sleeve 204 and the first member 202 can comprise a single component (i.e., a latch body). In other words, the sleeve 204 and the first member 202 can be fixed relative to each other. In such implementations, the driving member 302 can be moveably coupled to the latch body (i.e., sleeve 204 and first member 202).

FIGS. 3 and 4 further illustrate that the head assembly 126 can include a biasing member 330. The biasing member 330 can be positioned between the landing member 312 and the driving member 302. Thus, the biasing member 330 can bias the driving member 302 toward or into the sleeve 204. Thus, in one or more implementations, the biasing member 330 can bias the driving member 302 against the wedge members 300, thereby biasing the wedge members 300 radially outward. The biasing member 330 can comprise a mechanical (e.g., spring), magnetic, or other mechanism configured to bias the driving member 302 toward or into the sleeve 204. For example, FIGS. 3 and 4 illustrate that the biasing member 330 can comprise a coil spring.

Still further, FIGS. 3 and 4 illustrate that the head assembly 126 can include a fluid control member 342. The fluid control member 342 can include a piston 344 and a shaft 345. The shaft 345 can include a channel 346 defined therein. A piston pin 348 can extend within the channel 346 and be coupled to pin holes 350 within the first member 202 (and particularly the driving member 302). The channel 346 can thus allow the piston 344 to move axially relative to the driving member 302. In particular, as explained in greater detail below, the piston 344 can move axially relative to the first member 202 in and out of engagement with a seal or bushing 352 forming a valve. The interaction of the fluid control member 342 will be discussed in more detail hereinafter.

In one or more alternative implementations, the fluid control member 342 can be rigidly attached to the driving member 302. In such implementations, the piston pin 348 can extend into a pin hole rather than a channel 346, which prevents the fluid control member 342 from moving axially relative to the driving member 302.

In conjunction with the fluid control member 342, the core barrel assembly 110 can include various additional features to aid allowing the core barrel assembly 110 to travel within the drill string 104. In particular, the sleeve 204 can include one or more fluid ports 370 extending through the sleeve 204. Additionally, the sleeve 204 can include one or more axial pathways 372 extending at least partially along the length thereof. Similarly, first member 202 can include one or more fluid ports 376 extending through the first member 202. Furthermore, the first member 202 can include one or more axial pathways 378 extending at least partially along the length thereof.

One will appreciate in light of the disclosure herein that the fluid ports 370, 376 can allow fluid to flow from the outside diameter of the head assembly 126 into the center or bore of the head assembly 126. The axial pathways 372, 378 on the other hand can allow fluid to flow axially along the head assembly 126 between the outer diameter of the head assembly 126 and the inner diameter of a drill string 104. In addition to the fluid ports and axial pathways, the core barrel assembly 110 can include a central bore that can allow fluid to flow internally through the core barrel assembly 110.

As previously mentioned, the head assembly 126 can include a spearhead assembly 200. The spear head assembly 200 can be coupled to the first member 202 via a spearhead pin 360. The spearhead pin 360 can extend within a mounting channel 362 in the spearhead assembly 200, thereby allowing the spearhead assembly 200 to move axially relative to the first member 202.

Referring now to FIGS. 5-9 operation of the core barrel assembly 110, driven latch mechanism 128, and retracted groove 305 will now be described in greater detail. As previously mentioned, in one or more implementations of the present invention the core barrel assembly 110 can be lowered into a drill string 104. For example, FIG. 5 illustrates the core barrel assembly 110 as it is tripped into or down a drill string 104.

In particular, prior to placing the core barrel assembly 110 into the drill string 104, an operator can lock the wedge members 300 into the retracted groove 305. For example, the operator can press the pull the driving member 302 out of or away from the sleeve 204. By so doing the biasing member 330 can be compressed, and the wedge members 300 can be received into the retracted groove 305, as shown in FIG. 5.

Engagement between the retracted groove 305 and the wedge members 300 can cause the wedge members 300 to be seated in the retracted groove 305. Seating the wedge members 300 in the retracted groove 305 can result in a retention force between the wedge members 300, the retracted groove 305, and the walls of the latch openings 306 in the sleeve 204. The retention force can be sufficient to overcome the biasing force the biasing member 330 exerts on the first member 202 and the driving member 302, thereby maintaining or locking the wedge members 300 radially within the sleeve 204. As a result, the latch mechanism 128 can remain in a retracted state as the core barrel assembly 110 is tripped down the drill string 104. Maintaining the wedge members 300 retracted within the sleeve 204 can reduce contact between the wedge members 300 and the drill string 104, which in turn can reduce friction, and thereby allow for rapid tripping of the core barrel assembly 110 in and out of the drill string 104.

Additionally, one or more of the drill rods 108 of the drill string 104 may include variable wall thicknesses. In one or more implementations, at least one section of a drill rod 108 in the drill string 104 may have a varying cross-sectional wall thickness. For example, the inner diameter of the drill rod 108 can vary along the length thereof, while the outer diameter of the drill rod 108 remains constant. For example, FIG. 5 illustrates that the drill rod **108*a* can include a first end 500*a*, a middle portion 500*b*, and a second end 500*c*. As shown the middle section 500*b* of the drill rod 108*a* can be thinner than the ends 500*a*, 500*c* of the drill rod 108*a*. One will appreciate in light of the disclosure herein, that the thinner middle section 500*b* can create additional clearance between the core barrel assembly 110 and the inner surface 502 of the drill string 104**.

The cross-sectional wall thickness of the drill rod **108*a* may vary any suitable amount. For instance, the cross-sectional wall thickness of the drill rod 108*a* may be varied to the extent that the drill rod maintains sufficient structural integrity and remains compatible with standard drill rods, wirelines, and/or drilling tools. By way of example, the drill rod 108*a*** can have a cross-sectional wall thickness that varies between about 15% to about 30% from its thickest to its thinnest section. Nevertheless, the cross-sectional wall thickness of the drill rods may vary to a greater or lesser extent in one or more additional implementations.

The varying wall thickness may allow the core barrel assembly 110 to move through the drill string 104 with less resistance. Often, the drilling fluid and/or ground fluid within the drill string 104 may cause fluid drag and hydraulic resistance to the movement of the core barrel assembly 110. The varying inner diameter of drill string 104 may allow the drilling fluid or other materials (e.g., drilling gases, drilling muds, debris, air, etc.) contained in the drill string 104 to flow past the core barrel assembly 110 in greater volume, and therefore flow more quickly. For example, fluid may flow past core barrel assembly 110 as the core barrel assembly 110 passes through the wider sections of the drill string 104 during tripping. In combination with the latch mechanism 128 retained in a retracted position inside of the retracted groove 305, the contact between the latch mechanism 128 the inner surface 502 of the drill string 104 can be minimized, and thereby, significantly reduce drag between the drill string 104 and the core barrel assembly 110.

Referring now to FIG. 6, once the in-hole assembly or core barrel assembly 110 has reached its desired location within the drill string 104; the distal end of the core barrel assembly 110 can pass through the last drill rod and land on a landing ring that sits on the top of the outer tube 112. At this point the latching mechanism 128 can deploy thereby locking the core barrel assembly 110 axially and rotationally to the drill string 104. For example, the impact of the core barrel assembly 110 contacting the landing ring, in combination with the biasing forces created by the biasing member 330, can overcome the retention force maintaining the wedge members 300 within the retracted groove 305.

Once the core barrel assembly 110 has landed on the landing seat, core barrel assembly 110 can be submerged in a fluid. During drilling operations, this fluid can be pressurized. The pressurization of the fluid, along with the sealing contact between the distal end of the core barrel assembly 110, can cause the pressurized fluid to enter the ports 370, 376. Pressurized fluid entering the ports 370, 376 can produce a distally acting fluid force on the piston 344 of the fluid control member 342. The piston 344 in turn can exert a distally acting force that drives the fluid control member 342 distally until the proximal end of the channel 346 engages the pin 348. As a result, once the proximal end of the channel 346 engages the pin 348, the distally acting fluid force exerted on the fluid control member 342 is transferred through the pin 348 to the driving member 302, thereby pulling the driving member 302 toward or into the sleeve 204. This force created by the fluid control member 342 can work together with the biasing force created by the biasing member 330 to overcome the retention force maintaining the wedge members 300 within the retracted groove 305.

In any event, once the retention force has been overcome, the biasing member 330 can force the driving member 302 distally toward (and in some implementations at least partially into) the sleeve 204. Movement of the driving member 302 toward or into the sleeve 204 can urge the driving surfaces 304 into increasing engagement with the wedge members 300. In other words, axial translation of the driving member 302 toward the sleeve 204 can cause the driving surfaces 304 to force the wedge members 300 radially outward as they move along the tapered driving surfaces 304. This movement can cause the driving surfaces 304 drive the wedge members 300 radially outward (through the latch openings 306) and into engagement with the inner surface 502 of the drill string 104. In particular, the wedge members 300 can be driven into engagement with an annular groove 602 formed in the inner surface 502 of the drill string 104 as shown by FIG. 6.

With the wedge members 300 deployed in the annular groove 602, the driven latch mechanism 128 can lock the core barrel assembly 110 axially in the drilling position. In other words, the wedge members 300 and the annular groove 602 can prevent axial movement of the core barrel assembly 110 relative to the outer tube 112 or drill string 104. In particular, the driven latch mechanism 128 can withstand the drilling loads as a core sample enters the core barrel 124. Additionally, the drive latch mechanism 128 can maintain a deployed or latched condition despite vibration and inertial loading of mating head assembly components, due to drilling operations or abnormal drill string movement.

One will appreciate that when in the drilling position, the biasing member 330 can force the driving member 302 distally, thereby forcing the wedge members 300 radially outward into the deployed position. Thus, the driven latch mechanism 128 can help ensure that the wedge members 300 do not disengage or retract unintentionally such that the core barrel inner tube assembly rises from the drilling position in a down-angled hole, preventing drilling.

In addition to the foregoing, FIG. 6 further illustrates that when in the drilling position, the piston 344 can pass distally beyond the bushing 352. This can allow fluid to flow within the core barrel assembly 110. Thus, the fluid control member 342 can allow drilling fluid to reach the drill bit 106 to provide flushing and cooling as desired or needed during a drilling process. One will appreciate in light of the disclosure herein that a pressure spike can be created and then released as the core barrel assembly 110 reaches the drilling position and the piston 344 passes beyond the bushing 352. This pressure spike can provide an indication to a drill operator that the core barrel assembly 110 has reached the drilling position, and is latched to the drill string 104.

In addition to axially locking or latching the core barrel assembly 110 in a drilling position, the driven latch mechanism 128 can rotationally lock the core barrel assembly 110 relative to the drill string 104 such that the core barrel assembly 110 rotates in tandem with the drill string 104. As previously mentioned, this can prevent wear between the mating components of the core barrel assembly 110 and the drill string 104 (i.e., the wedge members 300, the inner surface 502 of the drills string 104, the landing shoulder at the distal end of the core barrel, the landing ring at the proximal end of the outer tube 112).

Figure 7:
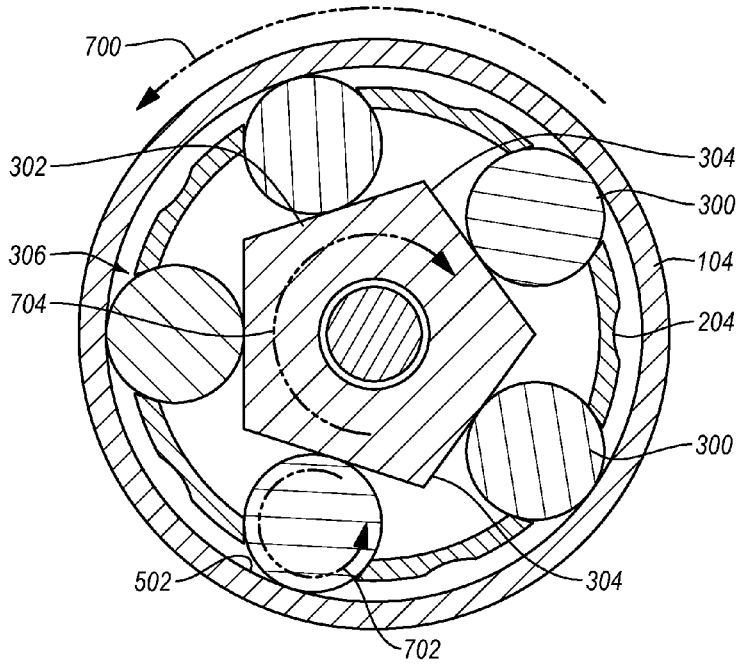
FIG. 7 illustrates a cross-sectional view of the core barrel assembly of FIG. 6 taken along the line 7-7 of FIG. 6.

In particular, referring to FIG. 7 as the drill string 104 rotates (indicated by arrow 700), the core barrel assembly 110 and the driving member 302 can have an inertia (indicated by arrow 704) that without out the driven latch mechanism 128 may tend to cause the core barrel assembly 110 not to rotate or rotate a slow rate then the drill string 104. As shown by FIG. 7, however, rotation of the drill string 104 causes the wedge members 300 to wedge in between the driving surfaces 304 of the driving member 302 and the inner surface 502 of the drill string 104 as the rotation of the drill string 104 tries to rotate the wedge members 300 relative to the driving member 302 (indicated by arrow 702). The wedging or pinching of the wedge members 300 in between the driving surfaces 304 and the inner surface 502 of the drill string 104 can rotationally lock the driving member 302 (and thus the core barrel assembly 110) relative to the drill string 104. Thus, the driven latch mechanism 128 can ensure that the core barrel assembly 110 rotates together with the drill string 104.

One will appreciate in light of the disclosure herein that configuration of the driving surfaces 304 and the inner surface 502 of the drill string 104 can create a circumferential taper as shown by FIG. 7. In other words, the distance between the inner surface 502 of the drill string 104 and the driving member 302 can vary circumferentially. This circumferential taper causes the wedge members 300 to wedge in between or become pinched between the drill string 104 and the driving member 302, thereby rotationally locking the core barrel assembly 110 to the drill string 104.

As shown by FIG. 7, in at least one implementation, the circumferential taper between the drill string 104 and the driving surfaces 104 can be created by the planar configuration of the driving surfaces 304. In alternative implementations, the driving surfaces 304 may not have a planar surface. For example, the driving surfaces 304 can have a concave, convex, rounded, v-shape, or other configuration as desired. In any event, one will appreciate that the configuration of the driving surfaces 304 can create a circumferential taper between the driving member 302 and the inner surface 502 of the drill string 104. In yet further implementations, the driving member 302 can have a generally circular cross-section, and the inner surface 502 of the drill string 104 can include a configuration to create a circumferential taper between the inner surface 502 of the drill string 104 and the driving surfaces 304 or driving member 302.

Figure 8:
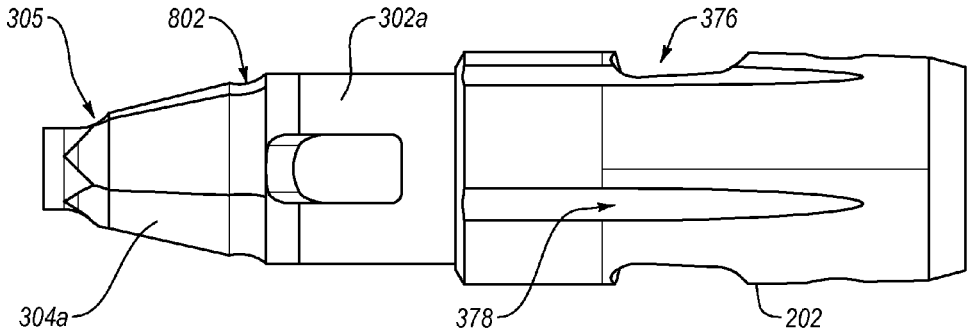
FIG. 8 illustrates a view of a core barrel component including both a retracted groove and a deployed groove.

In addition to a retention groove 305, in one or more implementations the driven latch mechanism 128 can also include a deployment groove. For example, FIG. 8 illustrates a driving member 302*a* including both a retention groove 305 and a deployment groove 802. The deployment groove 802 can extend radially into the driving surfaces 304*a* of the driving member 302*a*. In the implementation illustrated in the figures, the deployment groove 802 comprises a single groove extending circumferentially around the driving member 302*a*. In alternative implementations, however, the deployment groove 802 can comprise a plurality of grooves positioned on the driving member 304*a*. Each of the plurality of deployment grooves can receive and lock a single wedge member 300 in a deployed position.

In any case, in at least one implementation the deployment groove 802 can be positioned on the larger end of the taper of the driving member 302*a*. This can ensure that when the wedge members 300 are secured within the deployment groove 802, the wedge members 300 will be at least partially radially extended outside of the sleeve 204. The deployment groove 802 can maintain the wedge members 300 in the deployed position so as to be able to engage the annular groove 602 of the drill string 104. In particular, engagement between the wedge members 300 and the deployment groove 802 can result in a retention that locks or otherwise helps maintain the driven latch mechanism 128 in a deployed state.

In other words, the deployment groove 802 can lock the wedge members 300 in position along the driving member 302, thereby forcing the wedge members 300 radially outward into the deployed position. Thus, the driven latch mechanism 128 (and the deployment groove 802) can help ensure that the wedge members 300 do not disengage or retract unintentionally such that the core barrel inner tube assembly rises from the drilling position in a down-angled hole, preventing drilling.

Figure 9:
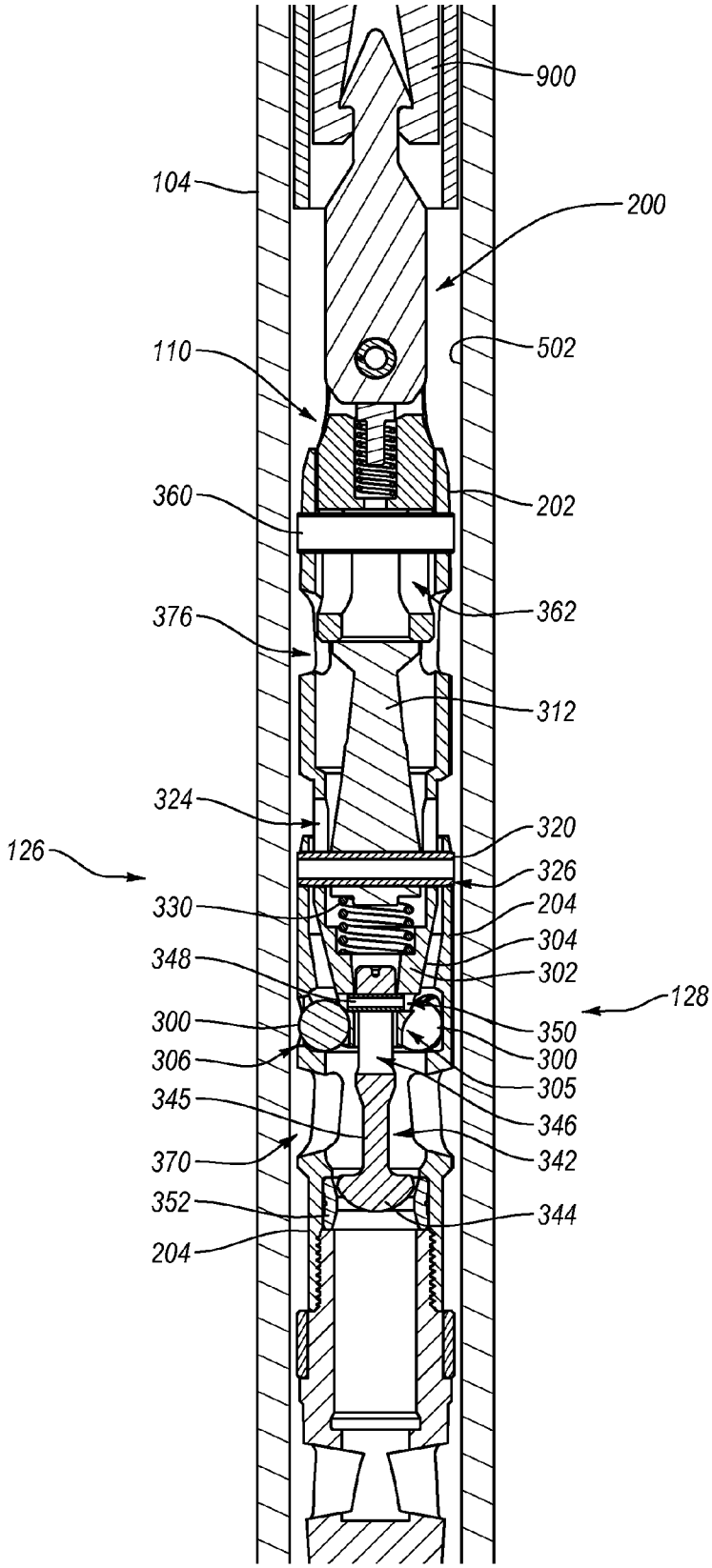
FIG. 9 illustrates a cross-sectional view of the core barrel assembly similar to FIG. 4, albeit with the driven latch mechanism in a released position allowing for retrieval of the core barrel assembly from the drill string.

At some point is may be desirable to retrieve the core barrel assembly 110, such as when a core sample has been captured. Referring to FIG. 9, in order to retrieve the core barrel assembly 110, a wireline can be used to lower an overshot assembly 900 into engagement with the spearhead assembly 200. The wireline can then be used to pull the overshot 900 and spearhead assembly 200 proximally. This in turn can act to draw the first member 202 proximately away from the sleeve 204.

Proximal movement of the first member 202 can cause the driving member 302 to move relative to the sleeve 204 and the wedge members 300. Proximal movement of the driving member 302 relative to the wedge members 300 can cause the wedge members 300 to be pulled from the deployment groove 802. Further movement of the driving member 302 relative to the wedge members 300 can cause the wedge members 300 to radially retract as they move along the tapered driving member 302. Once the first member 202 has been pulled proximately sufficiently, the wedge members 300 can move into the retracted groove 305, thereby locking them in radially within the sleeve 204. At this point, the distal end of the mounting slots 324 can engage the pin 320, thereby pulling the sleeve 204 proximately.

Implementations of the present invention can also include methods of drilling to obtain a core sample using a core drilling tools with retractably lockable driven latch mechanisms. The following describes at least one implementation of a method of obtaining a core sample with reference to the components and diagrams of FIGS. 1 through 9. Of course, as a preliminary matter, one of ordinary skill in the art will recognize that the methods explained in detail herein can be modified using one or more components of the present invention. For example, various acts of the method described can be omitted or expanded, and the order of the various acts of the method described can be altered as desired.

Thus, according to one implementation of the present invention, the method can involve manipulating a core barrel assembly 110 to position a plurality of wedge members 300 into at least one retracted groove 305 on driving member 302. For example, the method can include moving the driving member 302 relative to a sleeve 204 thereby causing the wedge members 300 to be received within a retracted groove 305. In at least one implementation, this may be done by pulling a first member 202 away from a sleeve 204. The at least one retracted groove 305 can hold the plurality of wedge members 300 in position along the driving member 302, and thus, radially within the sleeve 204.

The method can also involve inserting said core barrel assembly 110 within a drill string 104. For example, a user can lower the core barrel assembly 110 into the drill string 104. The method can then involve sending the core barrel assembly 110 along the drill string 104 to a drilling position. In at least one implementation, the core barrel assembly 110 can move along or down the drill string 104 to the drilling position under the force of gravity.

Upon reaching the drilling position, the plurality of wedge members 300 can automatically move out of the at least one retracted groove 305 into a deployed position in which the plurality of wedge members 300 extend at least partially radially outward of the sleeve 204. For example, a biasing force created by the biasing member 330 the retention force maintaining the wedge members 300 within the refracted groove 305 can be overcome. In some implementations, the biasing force can work in combination with an impact force created by the impact of the core barrel assembly 110 contacting the landing ring and/or a force generated by fluid acting on the fluid control member 342 to overcome the retention force. The biasing member 330 can then force driving member 302 to move axially relative to sleeve 204. This movement can force the wedge member 300 radially outward of the sleeve 204 until they engage the annular groove 602 within the drill string 104; thereby, locking the core barrel assembly 110 axially to the drill string 104. In some implementations, movement of the driving member 302 relative to sleeve 204 can force the wedge members 300 into the deployment groove 802, which can lock the wedge members 300 in the extended or deployed position.

The method can then involve rotating the drill string 104; thereby, causing the plurality of wedge members 300 to wedge between an inner surface 502 of said drill string 104 and the driving member 302, thereby rotationally locking the core barrel assembly 110 relative to the drill string 104. Still further, the method can involve advancing the drill string 104 into a formation 102 thereby causing a portion of the formation 102 to enter the core barrel assembly 110.

As previously alluded to previously, numerous variations and alternative arrangements may be devised by those skilled in the art without departing from the spirit and scope of this description. For example, core barrel assembly in accordance with the present invention can include a conventional latching mechanism (such as spring-driven pivoting latches or mechanical link latches) to provide axial locking, and a driven latch mechanism to provide rotational locking. For instance, this could be done by modifying a head assembly component such as a lower latch body to include roller elements that engage the inner diameter of the landing ring which sits in the outer tube. In such a configuration, the lower latch body can include driving surfaces and a retainer member that allows the roller elements to become wedged between the driving surfaces and the outer tube, thereby rotationally locking the lower latch body to the inner diameter of the landing ring. Thus, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A core barrel head assembly configured to be removably received within a drill string, the drill string having a longitudinal axis and an inner surface defining an annular groove, the core barrel head assembly comprising:

a sleeve having a plurality of openings extending there through;

a plurality of wedge members positioned at least partially within respective openings of the plurality of openings, the plurality of wedge members being unattached to the core barrel head assembly; and a driving member defining a plurality of driving surfaces, the driving member being positioned at least partially within the sleeve, the plurality of driving surfaces cooperating to define a circumferentially tapered outer surface of the driving member such that, at a selected axial position relative to the longitudinal axis of the drill string, the distance between the inner surface of the drill string and the outer surface of the driving member varies circumferentially about the outer surface of the driving member, the driving member including at least one first groove extending therein, the at least one first groove being configured to receive and maintain the plurality of wedge members in a retracted position within the sleeve, wherein the at least one first groove of the driving member is configured to maintain the plurality of wedge members in the retracted position such that the plurality of wedge members do not drag along the inner surface of the drill string during tripping of the core barrel head assembly, wherein the plurality of wedge members are adapted to axially lock the core barrel head assembly relative to the drill string by extending radially outward of the sleeve into the annular groove in the inner surface of the drill string, and wherein, upon rotation of the drill string, the plurality of driving surfaces are configured to wedge the plurality of wedge members between the inner surface of the drill string and the driving member such that the core barrel head assembly is rotationally locked relative to the drill string.

2. The core barrel head assembly as recited in claim 1, wherein movement of the driving member relative to the sleeve causes the plurality of wedge members to move radially in and out of the plurality of openings.

3. The core barrel head assembly as recited in claim 1, wherein wedge members of the plurality of wedge members are generally spherical.

4. The core barrel head assembly as recited in claim 1, wherein the driving member varies in diameter along at least a portion of its length.

5. The core barrel head assembly as recited in claim 1, further comprising:

a valve positioned within the sleeve; and a ball piston configured to engage the valve and prevent fluid from passing through the sleeve past the valve.

6. The core barrel head assembly as recited in claim 1, further comprising a biasing member configured to bias the driving member against the plurality of wedge members.

7. The core barrel head assembly as recited in claim 1, wherein driving surfaces of the plurality of driving surfaces are planar.

8. The core barrel head assembly as recited in claim 1, further comprising at least one second groove extending into the driving member, the at least one second groove being adapted to receive and maintain the plurality of wedge members in a deployed position wherein the plurality of wedge members extend radially outward of the sleeve.

9. A core barrel head assembly configured to be removably received within a drill string, the drill string having a longitudinal axis and an inner surface defining an annular groove, the core barrel head assembly comprising:

a sleeve defining a plurality of openings;

a driving member defining a plurality of driving surfaces, the driving member being moveably coupled to the sleeve, the plurality of driving surfaces cooperating to define a circumferentially tapered outer surface of the driving member such that, at a selected axial position relative to the longitudinal axis of the drill string, the distance between the inner surface of the drill string and the outer surface of the driving member varies circumferentially about the outer surface of the driving member;

a plurality of wedge members positioned on the driving member, the plurality of wedge members being unattached to the core barrel head assembly, wherein axial movement of the driving member relative to the sleeve causes the plurality of wedge members to move radially relative to the sleeve between a latched position and a retracted position, wherein, in the retracted position, each wedge member of the plurality of wedge members is positioned within a respective opening of the plurality of openings of the sleeve; and at least one first groove extending into the driving member, the at least one first groove being adapted to receive and lock the plurality of wedge members in the retracted position, wherein the at least one first groove of the driving member is configured to maintain the plurality of wedge members in the retracted position such that the plurality of wedge members do not drag along the inner surface of the drill string during tripping of the core barrel head assembly, wherein, in the latched position, the plurality of wedge members are adapted to axially lock the core barrel head assembly relative to the drill string by extending radially outward of the sleeve into the annular groove in the inner surface of the drill string, and wherein, in the latched position, upon rotation of the drill string, the plurality of driving surfaces are configured to wedge the plurality of wedge members between the inner surface of the drill string and the driving member such that the core barrel head assembly is rotationally locked relative to the drill string.

10. The core barrel head assembly as recited in claim 9, wherein wedge members of the plurality of wedge members are generally spherical.

11. The core barrel head assembly as recited in claim 10, wherein the plurality of driving surfaces comprise a plurality of generally planar driving surfaces extending along the driving member relative to the longitudinal axis of the drill string, wherein the plurality of wedge members are configured for engagement with the plurality of generally planar driving surfaces.

12. The core barrel head assembly as recited in claim 11, further comprising a biasing member, wherein the biasing member biases the planar driving surfaces against the plurality of wedge members.

13. The core barrel head assembly as recited in claim 12, wherein the biasing member biases the driving member toward the sleeve.

14. The core barrel head assembly as recited in claim 9, further comprising at least one second groove extending into the driving member, the at least one second groove being adapted to receive and maintain the plurality of wedge members in the latched position wherein the plurality of wedge members extend radially outward of the sleeve.

15. A drilling system for retrieving a core sample, comprising:

a drill string having a longitudinal axis, an inner surface, and a plurality of drill rods, the inner surface of the drill string defining an annular groove;

a core barrel assembly having a sleeve defining a plurality of openings, the core barrel assembly being adapted to be inserted within the drill string; and a driven latch mechanism positioned within the core barrel assembly;

wherein the driven latch mechanism comprises a plurality of wedge members positioned on a driving member, the plurality of wedge members being unattached to the core barrel assembly, the driving member defining a plurality of driving surfaces, the plurality of driving surfaces cooperating to define a circumferentially tapered outer surface of the driving member such that, at a selected axial position relative to the longitudinal axis of the drill string, the distance between the inner surface of the drill string and the outer surface of the driving member varies circumferentially about the outer surface of the driving member, the driving member having at least one first groove adapted to receive and lock the plurality of wedge members in a retracted position wherein the plurality of wedge members are radially positioned within the core barrel assembly, wherein the plurality of wedge members are adapted to axially lock the core barrel assembly relative to the drill string by extending radially outward of the sleeve into the annular groove in the inner surface of the drill string, wherein, upon rotation of the drill string, the plurality of driving surfaces are configured to wedge the plurality of wedge members between the inner surface of the drill string and the driving member such that the core barrel head assembly is rotationally locked relative to the drill string, and wherein the at least one first groove of the driving member is configured to maintain the plurality of wedge members in the retracted position such that the plurality of wedge members do not drag along the inner surface of the drill string during tripping of the core barrel head assembly.

16. The drilling system as recited in claim 15, further comprising at least one second groove, wherein the at least one second groove is adapted to lock the plurality of wedge members in a deployed position wherein the plurality of wedge members are radially positioned at least partially outside of the core barrel assembly.

17. The drilling system as recited in claim 15, wherein wedge members of the plurality of wedge members comprise generally spherical balls.

18. The drilling system as recited in claim 15, wherein at least one drill rod of the plurality of drill rods includes an inner diameter that varies along the length of the at least one drill rod.

19. The drilling system as recited in claim 15, further comprising a spearhead assembly coupled to the barrel assembly.

20. A method of drilling using a core barrel assembly comprising a sleeve, a driving member, and a plurality of wedge members, comprising:

manipulating the core barrel assembly to position the plurality of wedge members into at least one retracted groove on the driving member, the plurality of wedge members being unattached to the core barrel assembly, the driving member defining a plurality of driving surfaces, the at least one retracted groove being adapted to hold the plurality of wedge members radially within the sleeve in a retracted position;

inserting the core barrel assembly within a drill string, the drill string having a longitudinal axis, wherein the plurality of driving surfaces of the driving member cooperate to define a circumferentially tapered outer surface of the driving member such that, at a selected axial position relative to the longitudinal axis of the drill string, the distance between the inner surface of the drill string and the outer surface of the driving member varies circumferentially about the outer surface of the driving member;

moving the core barrel assembly within the drill string to a drilling position, wherein the driving member is configured to maintain the plurality of wedge members in the retracted position within the at least one retracted groove such that the plurality of wedge members do not drag along an inner surface of the drill string during movement of the core barrel assembly within the drill string, and wherein upon reaching the drilling position the plurality of wedge members are configured to move out of the at least one retracted groove into a deployed position in which the plurality of wedge members extend at least partially radially outward of the sleeve, thereby axially locking the core barrel assembly relative to the drill string; and rotating the drill string thereby causing the plurality of driving surfaces of the driving member to wedge the plurality of wedge members between an inner surface of the drill string and the driving member, thereby rotationally locking the core barrel assembly relative to the drill string.

21. The method as recited in claim 20, further comprising:

lowering an overshot onto a spearhead of the core barrel assembly; and pulling on the overshot to retract the core barrel assembly;

wherein the pulling moves the plurality of wedge members into the at least one retracted groove.

22. The method as recited in claim 20, wherein the plurality of wedge members are locked within a deployment groove formed in the driving member when in the deployed position.

23. The method as recited in claim 20, wherein a biasing member forces the driving member to move axially relative to the sleeve upon reaching the drilling position.

24. The method as recited in claim 20, further comprising advancing the drill string into a formation thereby causing a portion of the formation to enter the core barrel assembly.

* * * * *